US009631410B2

(12) United States Patent
Nakao

(10) Patent No.: US 9,631,410 B2
(45) Date of Patent: Apr. 25, 2017

(54) DOOR OPENING/CLOSING DEVICE

(71) Applicant: The Yokohama Rubber Co., LTD., Minato-ku, Tokyo (JP)

(72) Inventor: Kazushi Nakao, Hiratsuka (JP)

(73) Assignee: The Yokohama Rubber Co., LTD. (JP)

( * ) Notice: Subject to any disclaimer, the term of this patent is extended or adjusted under 35 U.S.C. 154(b) by 242 days.

(21) Appl. No.: 14/395,814

(22) PCT Filed: Apr. 18, 2013

(86) PCT No.: PCT/JP2013/002639

§ 371 (c)(1),
(2) Date: Oct. 20, 2014

(87) PCT Pub. No.: WO2013/157273

PCT Pub. Date: Oct. 24, 2013

(65) Prior Publication Data

US 2015/0096145 A1 Apr. 9, 2015

(30) Foreign Application Priority Data

Apr. 20, 2012 (JP) ..... 2012-096361

(51) Int. Cl.
*E05F 1/08* (2006.01)
*E05F 1/10* (2006.01)
(Continued)

(52) U.S. Cl.
CPC ..... *E05F 1/1008* (2013.01); *E05D 5/10* (2013.01); *E05D 7/081* (2013.01); *E05D 15/266* (2013.01);
(Continued)

(58) Field of Classification Search
CPC ..... E05D 15/26; E05D 15/266; E05F 1/1008; E05F 1/14; E05F 1/1215; Y10T 16/5995;
(Continued)

(56) References Cited

U.S. PATENT DOCUMENTS

721 A * 4/1838 Hoyt et al. ..... E05F 1/1215 16/305
253,851 A * 2/1882 De Long et al. ..... E05F 1/1016 16/76

(Continued)

FOREIGN PATENT DOCUMENTS

| | | |
|---|---|---|
| FR | 469612 | 8/1914 |
| JP | H01-142021 | 9/1989 |
| JP | 2010-285831 | 12/2010 |
| JP | 2012-012864 | 1/2012 |

OTHER PUBLICATIONS

International Search Report for International Application No. PCT/JP2013/002639, dated Jul. 30, 2013, 4 pages, Japan.

*Primary Examiner* — Victor Batson
*Assistant Examiner* — Matthew Sullivan
(74) *Attorney, Agent, or Firm* — Thorpe North & Western

(57) ABSTRACT

A door opening/closing device includes a shaft member installed on a first door panel side so that it cannot rotate. Both ends of a torsion spring in the door opening/closing device are latched to a second door panel side via torsion spring latching walls, and a center portion of the torsion spring is latched to the first door panel side via a latched member, a latching portion, and the shaft member. When the first door panel and the second door panel are pulled from the state in which the doorway is closed, the first door panel and the second door panel fold about an outside cylindrical member as center. The outside cylindrical member rotates relative to the shaft member. First and second coil portions deform elastically in the direction that they are each wound tighter, and the first and second door panels are opened and the doorway is opened.

3 Claims, 9 Drawing Sheets

(51) Int. Cl.

| | |
|---|---|
| ***E05F 1/12*** | (2006.01) |
| ***E06B 3/48*** | (2006.01) |
| ***E06B 3/70*** | (2006.01) |
| ***E05D 5/10*** | (2006.01) |
| ***E05D 7/081*** | (2006.01) |
| *E05F 1/14* | (2006.01) |
| *E05D 15/26* | (2006.01) |

(52) U.S. Cl.
CPC ..... *E05F 1/1215* (2013.01); *E06B 3/481* (2013.01); *E06B 3/7007* (2013.01); *E05D 15/26* (2013.01); *E05D 2005/102* (2013.01); *E05F 1/14* (2013.01); *E05Y 2800/00* (2013.01); *E05Y 2800/26* (2013.01); *E05Y 2800/28* (2013.01); *E05Y 2900/112* (2013.01); *E05Y 2900/132* (2013.01); *Y10T 16/5995* (2015.01)

(58) Field of Classification Search
CPC ..... Y10T 16/304; E06B 3/481; E06B 3/7007; E05Y 2900/132; E05Y 2900/12
See application file for complete search history.

(56) References Cited

U.S. PATENT DOCUMENTS

| | | | | | |
|---|---|---|---|---|---|
| 1,408,583 | A * | 3/1922 | Glancey | E05F 1/1215 | 16/256 |
| 1,487,233 | A * | 3/1924 | Glancey | E05F 1/1215 | 16/256 |
| 1,539,921 | A * | 6/1925 | Tharp | E05F 1/1215 | 16/305 |
| 2,150,435 | A * | 3/1939 | Floreth | E05F 1/1016 | 16/76 |
| 4,649,597 | A * | 3/1987 | Cacicedo | E05F 1/1215 | 16/253 |
| 5,191,678 | A * | 3/1993 | Firari | E05F 5/02 | 16/305 |
| 8,533,909 | B2 * | 9/2013 | Minegishi | E05D 15/266 | 16/72 |
| 9,206,636 | B2 * | 12/2015 | Nagl | E05F 1/1215 | |
| 2005/0044661 | A1 * | 3/2005 | Cho | E05F 1/1215 | 16/76 |
| 2011/0139806 | A1 * | 6/2011 | Kullman | B65F 1/068 | 220/810 |
| 2012/0036679 | A1 * | 2/2012 | Chen | E05D 11/084 | 16/284 |

* cited by examiner

FIG. 4A
FIG. 4B
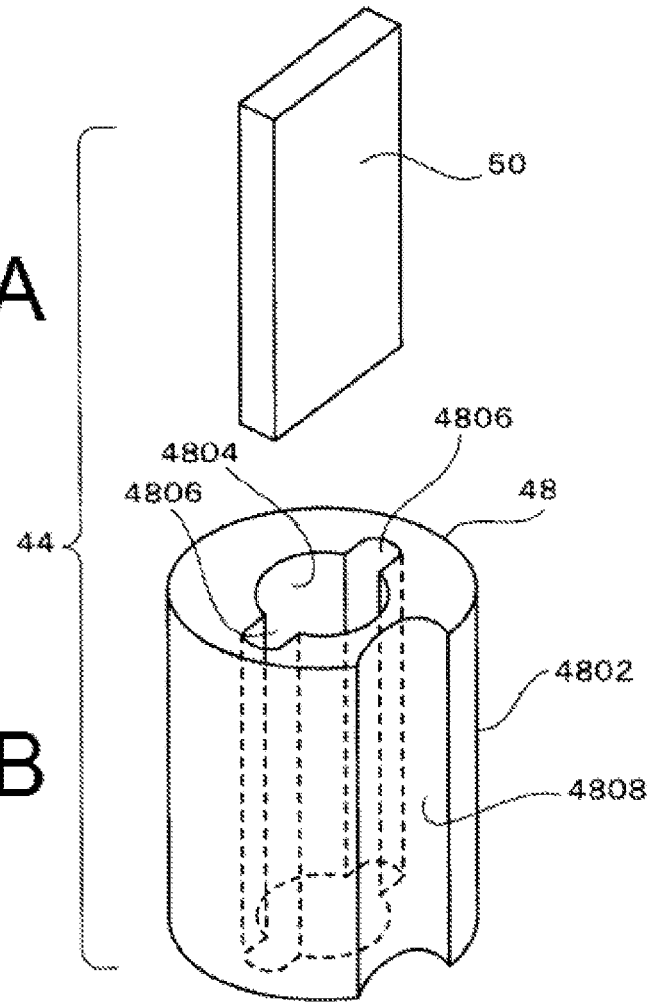
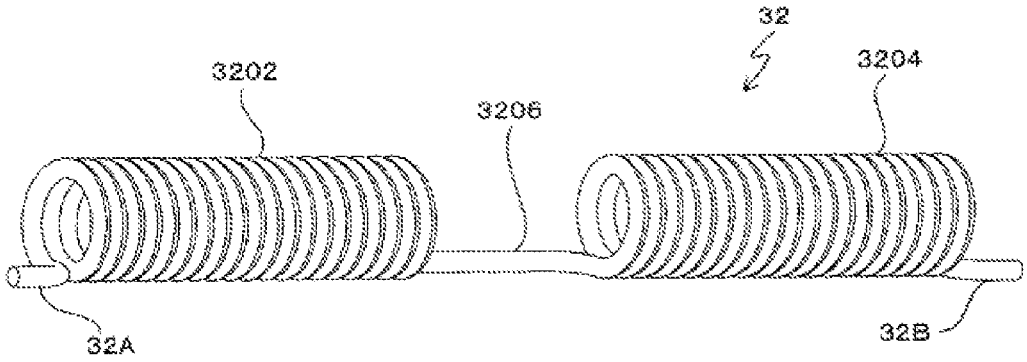
FIG. 5

DOOR OPENING/CLOSING DEVICE

TECHNICAL FIELD

The present technology relates to a door opening/closing device, and more particularly relates to a door opening/closing device that is advantageous in terms of increasing the durability of a torsion spring used in a door opening/closing device for a double folding door.

BACKGROUND

Conventionally, a door opening/closing device for a double folding door that closes an opening when the two door panels are in the unfolded state, and opens the opening when the door panels are in the folded state includes a support shaft that foldably joins the two door panels, and a torsion spring that is coaxially disposed on the support shaft.

Then, the door panels are opened against the resistance of the elastic force of the torsion spring, and the door panels are automatically closed by the elastic force of the torsion spring.

However, in a conventional door opening/closing device, a torsion spring having a single coil portion is used, so, structurally, the torsion spring must be used so that when the door is opened, the coil portion is wound open, and when the door is closed, the coil portion is wound tight.

SUMMARY

When a load is applied to the torsion spring, deformation in the direction that the coil portion is wound tight is preferably in terms of durability to deformation in the direction that the coil portion is wound open.

The present technology provides a door opening/closing device that is advantageous in terms of increasing the durability of the torsion spring used in the door opening/closing device.

The present technology provides a door opening/closing device for a double folding door, comprising: a support shaft that foldably connects a first door panel and a second door panel; and a torsion spring provided between the first door panel and the second door panel coaxially with the axial center of the support shaft, an opening being closed when the first door panel and the second door panel are in the unfolded state, the opening being open when the door panels are in the folded state, and the torsion spring impelling the first door panel and the second door panel in the direction to close the opening, wherein the torsion spring is made from a single wire member and includes a first coil portion and a second coil portion in which the wire member is wound in opposite directions to each other coaxially with a spacing therebetween, and a latched member that connects the first coil portion and the second coil portion, the latched member is latched to the first door panel side, the end portion of the first coil portion on the opposite side to the latched member and the end portion of the second coil portion on the opposite side to the latched member are latched to the second door panel side, and the first door panel and the second door panel are impelled in the direction to close the opening by the elastic force that tends to restore the first coil portion and the second coil portion in the wind open direction.

According to the present technology, when the first door panel and the second door panel are opened, in other words, when a load is applied, the latched member is latched to the first door panel side, and both ends of the torsion spring are latched to the second door panel side, and the first coil portion and the second coil portion are deformed in the direction to wind them tighter, which is desirable in terms of durability of the torsion spring. Therefore, the durability of the torsion spring is increased, which is advantageous in terms of increasing the durability of the door opening/closing device.

BRIEF DESCRIPTION OF THE DRAWINGS

FIG. 1 is an explanatory view of door panels of a toilet unit.

FIG. 4 is an explanatory view of an attaching member, FIG. 4A is a perspective view of a latch plate, and FIG. 4B is a perspective view of a cylindrical member.

FIG. 5 is a perspective view of a torsion spring.

DETAILED DESCRIPTION

The following is a description of the door opening/closing device according to an embodiment of the present technology applied to a double-folding door that opens and closes the opening of a toilet unit in an aircraft.

Figure 1A:
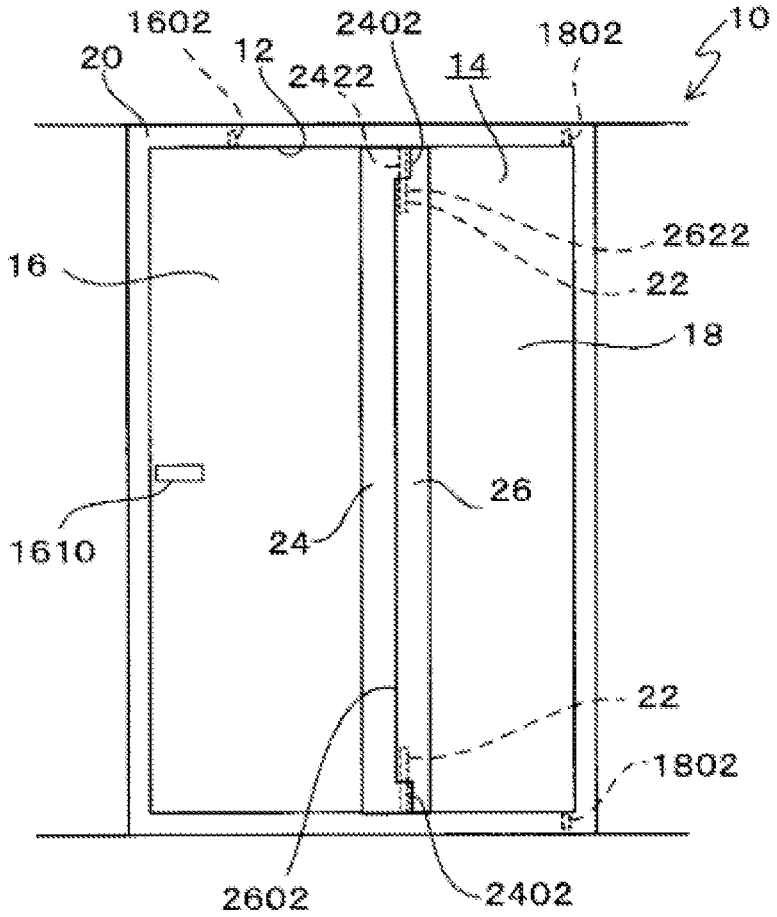
FIG. 1A is a front view.
Figure 1B:
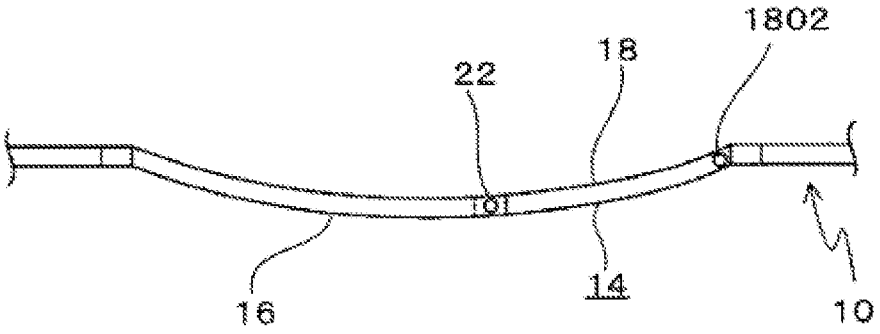
FIG. 1B is a plan view.
Figure 1C:
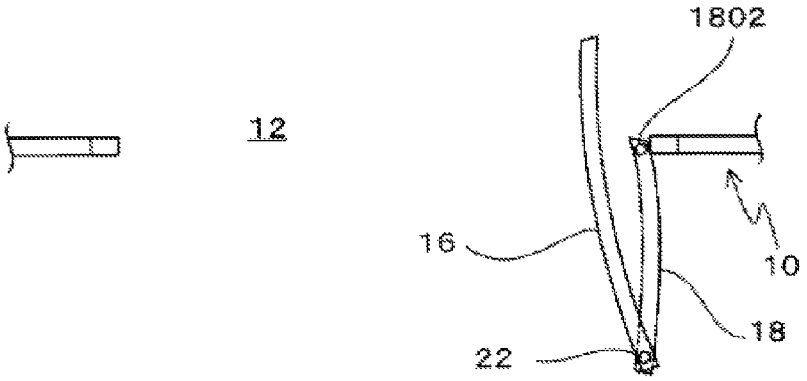
FIG. 1C is a plan view of the door panels when the opening is in the open state.

As illustrated in FIG. 1, a door 14 that opens and closes a doorway 12 of a toilet unit 10 is a double-folding door that includes a first door panel 16 and a second door panel 18, and, in the embodiment, the opening is the doorway 12.

A first end in the width direction of the first door panel 16 is configured so that a guide shaft 1602 provided in the top end of the first door panel 16 moves in the width direction of the doorway 12 by sliding along a guide rail provided in the top edge portion of an installation frame 20.

The top and bottom portions of a second end in the width direction of the first door panel 16 are foldably connected to a first end in the width direction of the second door panel 18 via a door opening/closing device 22.

Also, a handle 1610 is provided in the first door panel 16.

A second end in the width direction of the second door panel 18 is rotatably connected to the top edge portion and the bottom edge portion of the installation frame 20 via a rotational shaft 1802.

The first door panel 16 and the second door panel 18 are curved convex to the outside of the toilet panel, configured so that, in the unfolded state, the first door panel 16 and the second door panel 18 close the doorway 12, and, in the folded state, the first door panel 16 and the second door panel 18 open the doorway 12.

In more detail, a first hinge piece 24 is fitted to the second end in the width direction of the first door panel 16, and a second hinge piece 26 is fitted to the first end in the width direction of the second door panel 18. Therefore, the first door panel 16 is configured to include the first hinge piece 24, and the second door panel 18 is configured to include the second hinge piece 26.

Also, convex portions 2402 on the top and bottom ends of the first hinge piece 24 are aligned with the top and bottom of a convex portion 2602 of the second hinge piece 26, and are foldably connected by the door opening/closing device 22.

The door opening/closing device 22 that connects the convex portion 2402 of the top end of the first hinge piece 24 and the top portion of the convex portion 2602 of the second hinge piece 26 has the same configuration as the door opening/closing device 22 that connects the convex portion 2402 at the bottom end of the first hinge piece 24 and the bottom portion of the convex portion 2602 of the second hinge piece 26, so the description is provided taking as an example the door opening/closing device 22 that connects the convex portion 2402 of the top end of the first hinge piece 24 and the top portion of the convex portion 2602 of the second hinge piece 26.

Figure 2:
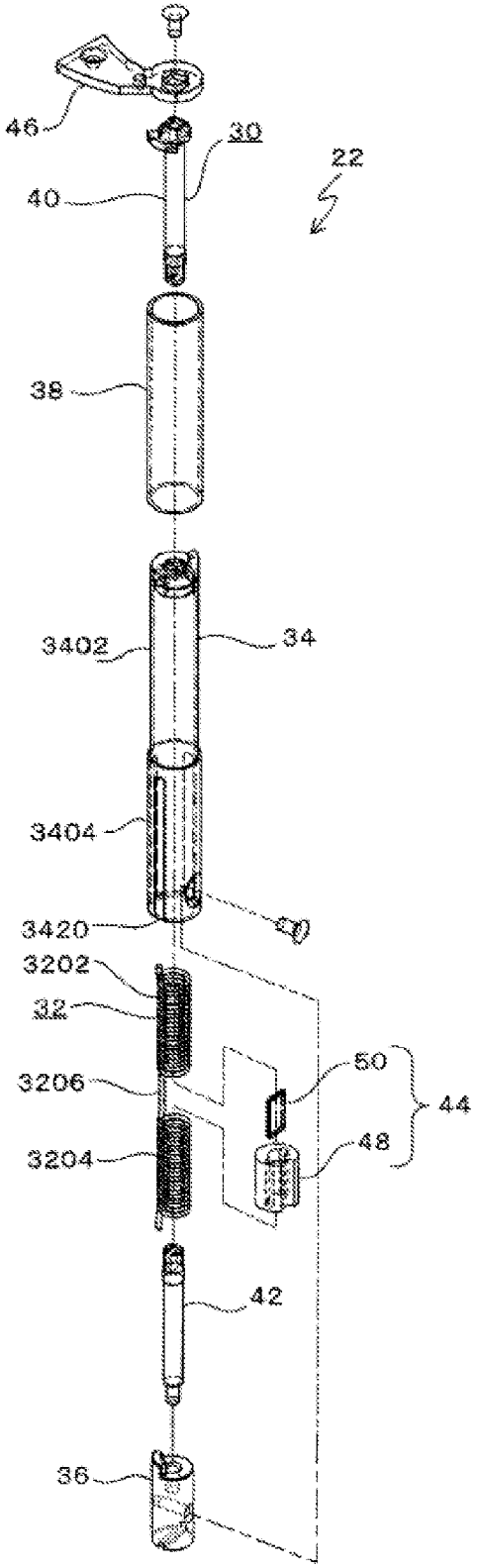
FIG. 2 is an exploded perspective view of the members from which the door opening/closing device is configured.

As illustrated in FIG. 2, the door opening/closing device 22 includes a shaft member 30, a torsion spring 32, an outside cylindrical member 34, an inside cylindrical member 36, and a bush 38.

Figure 3A:
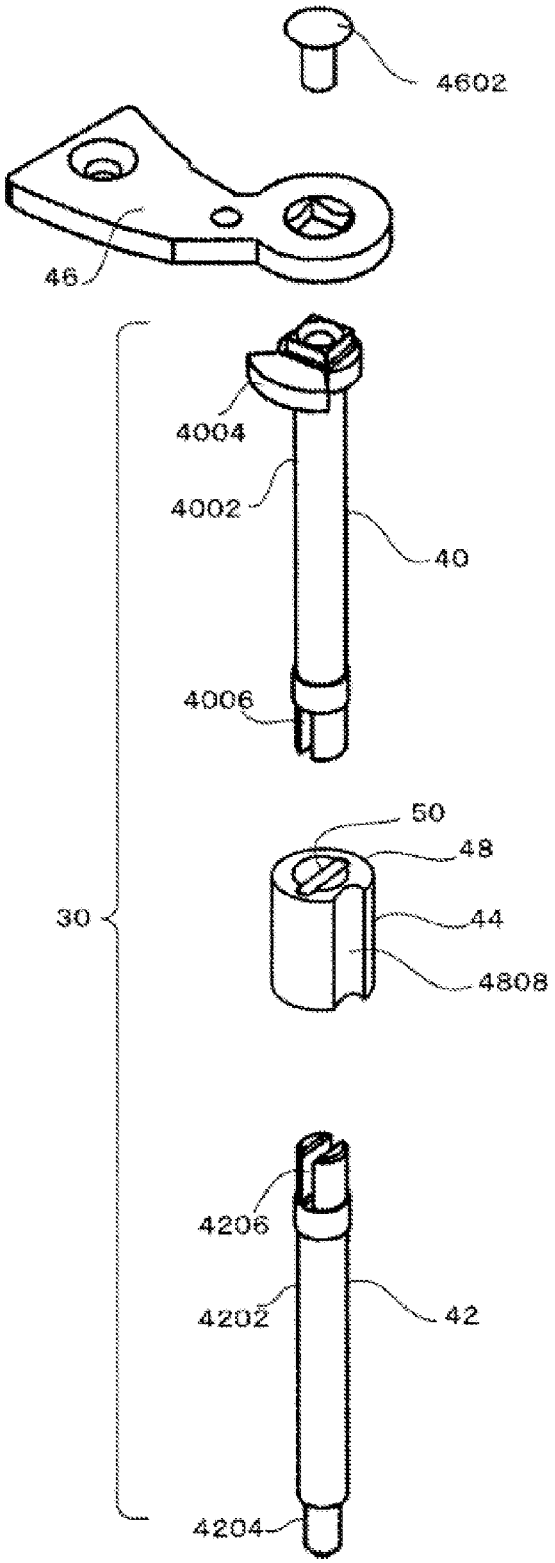
FIG. 3A is an exploded perspective view of a shaft member.
Figure 3B:
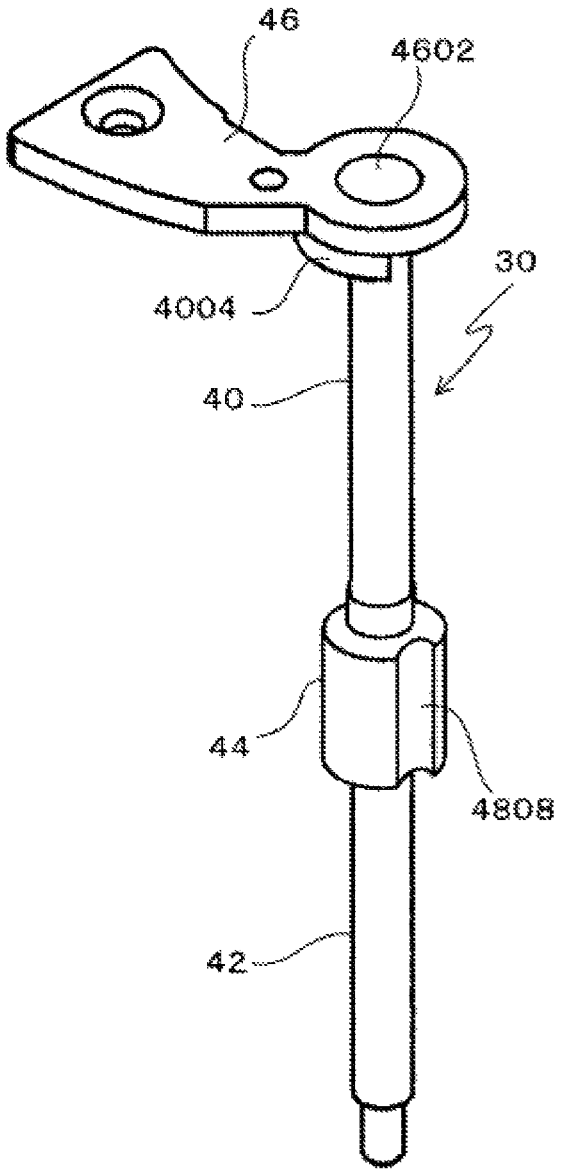
FIG. 3B is a perspective view of the shaft member.

As illustrated in FIG. 3A and 3B, the shaft member 30 is configured to include a first shaft 40, a second shaft 42, and an attaching member 44.

The first shaft 40 includes a shaft portion 4002, a fan-shaped shaft member side stopper 4004 provided on the top end of the shaft portion 4002, and a groove 4006 provided in the bottom end of the shaft portion 4002.

An installation piece 46 is connected to the top end of the shaft portion 4002 via a screw 4602 so that it can rotate integrally with the first shaft 40. The installation piece 46 is fitted to the top end surface of the first hinge piece 24 with a screw that is not illustrated in the drawings, and therefore, the top end of the first shaft 40 is fitted so that it cannot rotate to the top end surface of the first hinge piece 24, in other words, to the first door panel 16 side.

The second shaft 42 includes a shaft portion 4202, a small diameter portion 4204 provided on the bottom end of the shaft portion 4202, and a groove 4206 provided in the top end of the shaft portion 4202. The small diameter portion 4204 is rotatably supported on the second door panel 18 side as described later.

As illustrated in FIG. 4A and 4B, the attaching member 44 includes a cylindrical member 48 and a latch plate 50.

The cylindrical member 48 includes a cylindrical shaped main body portion 4802, a pair of fitting grooves 4806 formed in locations opposite each other on the inner circumferential surface of a central hole 4804 in the main body portion 4802, and a groove-shaped latching portion 4808 that extends in the axial direction, formed on the outer cylindrical surface of the main body portion 4802.

The latch plate 50 is inserted into the pair of fitting grooves 4806.

The bottom end of the first shaft 40 is inserted into the central hole 4804 of the cylindrical member 48 from above, and by fitting the top half of the latch plate 50 into the groove 4006, the first shaft 40 and the attaching member 44 are connected so that they rotate integrally.

Also, by inserting the top end of the second shaft 42 into the central hole 4804 of the cylindrical member 48 from below, and fitting the bottom half of the latch plate 50 to the groove 4206, the second shaft 42 and the attaching member 44 are connected so that they rotate integrally.

Therefore, the first shaft 40 and the second shaft 42 are connected via the attaching member 44 so that they rotate integrally about the same axis.

The torsion spring 32 is fitted to the shaft member 30 configured in this way.

As illustrated in FIG. 5, the torsion spring 32 is formed from a single wire member, and includes a first coil portion 3202, a second coil portion 3204, and a latched member 3206.

The first coil portion 3202 and the second coil portion 3204 have the same internal diameter, the same external diameter, have the same number of turns, and are formed coaxially, but their orientations of winding the wire member are opposite to each other.

The latched member 3206 extends in a linear manner between the first coil portion 3202 and the second coil portion 3204, thereby connecting these coil portions 3202, 3204.

A first coil portion latching end 32A projects from an end portion of the first coil portion 3202, and a second coil portion latching end 32B projects from an end portion of the second coil portion 3204.

Figure 6:
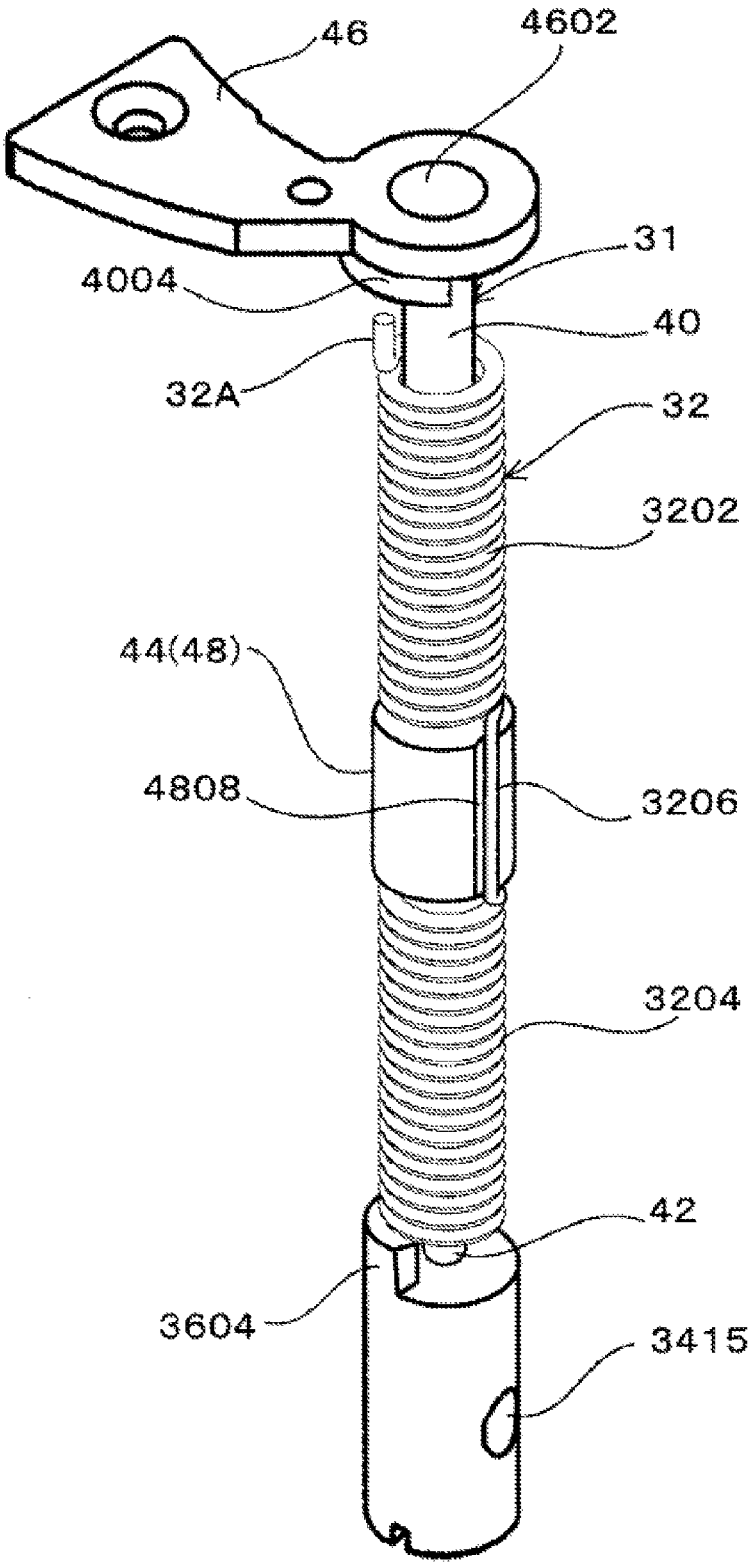
FIG. 6 is a perspective view of the torsion spring fitted to the shaft member.

Also, as illustrated in FIG. 6, the first coil portion 3202 is wound around the first shaft 40, and the second coil portion 3204 is wound around the second shaft 42, and the latched member 3206 is latched to the latching portion 4808.

In the embodiment, the shaft member 30 and the torsion spring 32 are disposed on the first door panel 16 and the second door panel 18 using the outside cylindrical member 34 and the inside cylindrical member 36.

Figure 7A:
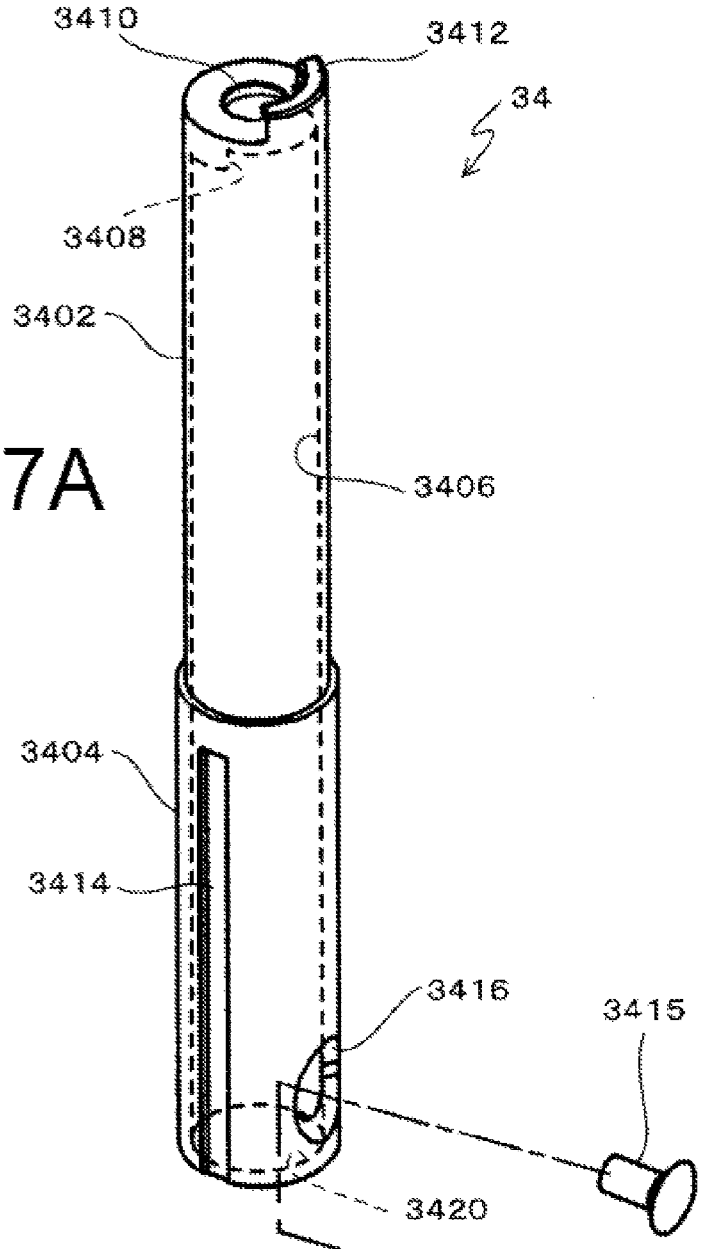
FIG. 7A is a perspective view of an outside cylindrical member.

As illustrated in FIG. 7A, the outside cylindrical member 34 includes a small diameter portion 3402 and a large diameter portion 3404, with a housing hole 3406 with a uniform inside diameter formed in the centers thereof.

A torsion spring latching wall 3408 projects from the end on the small diameter portion 3402 side inside the housing hole 3406.

Also, an insertion hole 3410 that links to the housing hole 3406 is opened in the end portion of the small diameter portion 3402, and a cylindrical shaped member side stopper wall 3412 projects from the periphery of the insertion hole 3410.

A plurality of mating grooves 3414 that extend in the axial direction spaced in the circumferential direction, and, a counterbore 3416 that accommodates the head of a screw 3415 are formed in the large diameter portion 3404, and an opening 3420 of the housing hole 3406 is located on the end portion of the large diameter portion 3404.

Figure 7B:
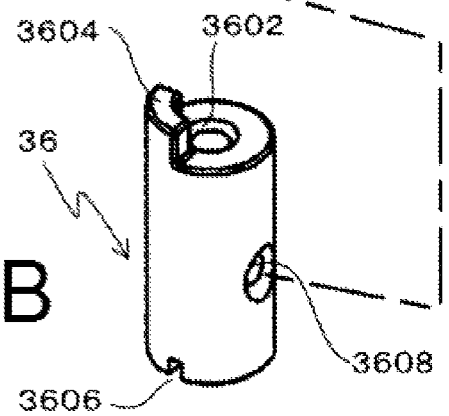
FIG. 7B is a perspective view of an inside cylindrical member.

As illustrated in FIG. 7B, the inside cylindrical member 36 is inserted into the housing hole 3406 from the opening 3420 of the large diameter portion 3404 of the outside cylindrical member 34, and is fixed to the outside cylindrical member 34 so that it cannot rotate by the screw 3415 as described later.

A support hole 3602 that rotatably supports the small diameter portion 4204 of the second shaft 42 is formed in a first end of the inside cylindrical member 36, and a torsion spring latching wall 3604 projects from the periphery of the support hole 3602.

Also, a groove 3606 is formed in a second end of the inside cylindrical member 36.

Also, a screw hole 3608 into which the screw 3415 is screwed is formed in the inside cylindrical member 36.

The shaft member 30 and the torsion spring 32 are arranged on the first door panel 16 and the second door panel 18 as follows.

Figure 8:
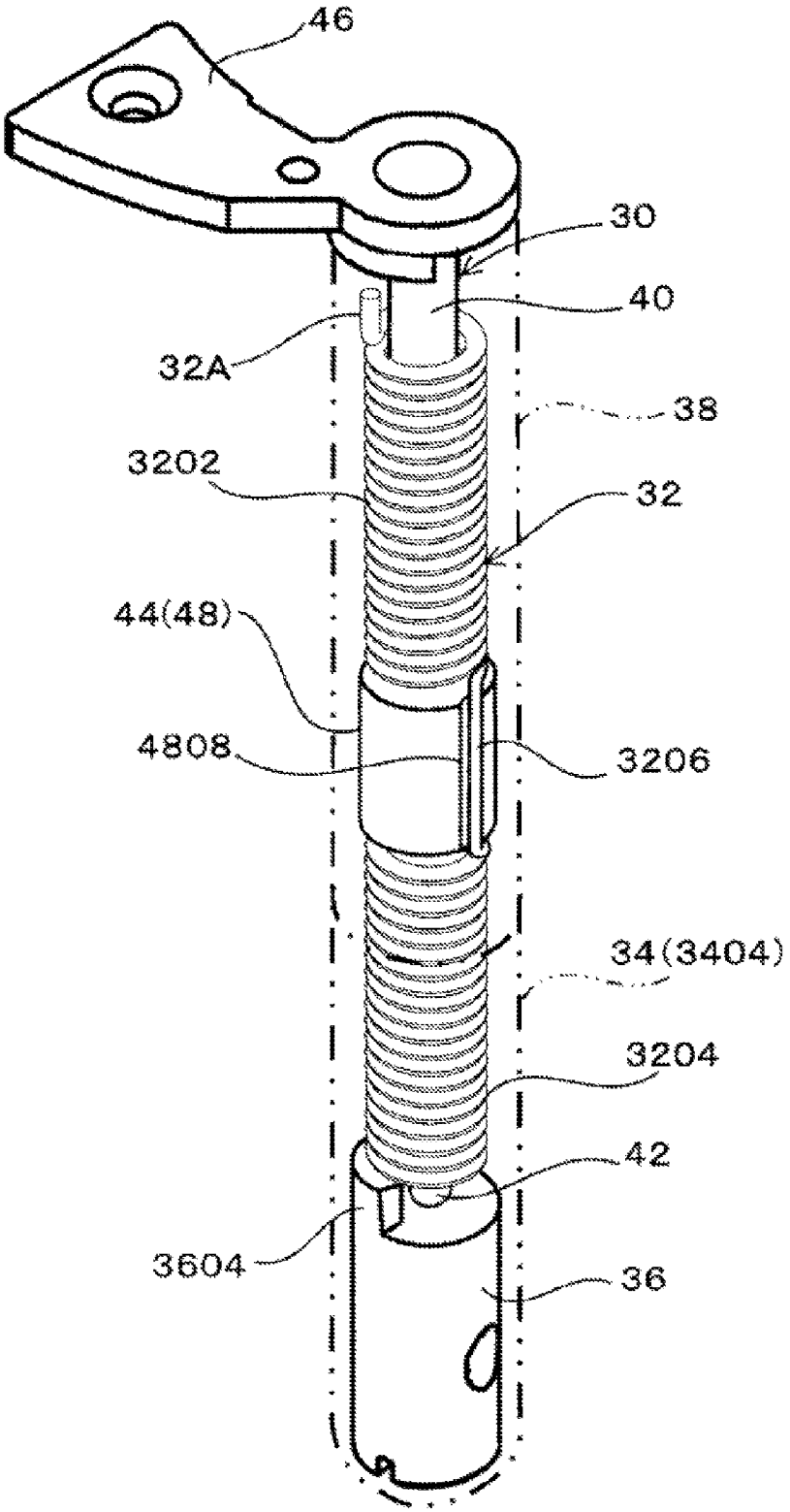
FIG. 8 is a perspective view illustrating the torsion spring fitted to the shaft member, with both covered by the outside cylindrical member and a bush.

As illustrated in FIG. 7 and FIG. 8, the first shaft 40 is inserted from the groove 4006 into the housing hole 3406 from the insertion hole 3410 at the first end of the outside cylindrical member 34.

Also, the attaching member 44 is assembled onto the torsion spring 32 latching the latched member 3206 to the latching portion 4808, the second shaft 42 is inserted into the second coil portion 3204 from the groove 4206, the tip of the second shaft 42 is inserted into the central hole 4804 of the cylindrical member 48, and the groove 4206 is latched to the latch plate 50.

In this state, the torsion spring 32 and the second shaft 42 are inserted into the housing hole 3406 from the opening 3420 of the outside cylindrical member 34, and, in this way, the first shaft 40 is inserted into the first coil portion 3202, and the tip of the first shaft 40 is inserted into the central hole 4804 of the cylindrical member 48, and the groove 4006 is latched with the latch plate 50.

Then, the inside cylindrical member 36 is inserted into the opening 3420 of the outside cylindrical member 34, and the outside cylindrical member 34 and the inside cylindrical member 36 are connected so that they rotate integrally using the screw 3415.

In this state, the first coil portion latching end 32A of the end portion of the first coil portion 3202 is latched to the torsion spring latching wall 3408 on the inside of the outside cylindrical member 34, and the second coil portion latching end 32B of the end portion of the second coil portion 3204 is latched to the torsion spring latching wall 3604 of the inside cylindrical member 36 inside the outside cylindrical member 34.

Also, the shaft member side stopper 4004 is disposed so that it can contact the cylindrical member side stopper wall 3412 of the end portion of the outside cylindrical member 34, so when the first door panel 16 and the second door panel 18 are in the fully closed state, the shaft member side stopper 4004 contacts a first end in the circumferential direction of the cylindrical member side stopper wall 3412, and, when the first door panel 16 and the second door panel 18 are in the fully open state, the shaft member side stopper 4004 contacts a second end in the circumferential direction of the cylindrical member side stopper wall 3412, thereby restricting the fully closed state and the fully open state.

In this way, the small diameter portion 3402 of the outside cylindrical member 34 into which the shaft member 30, the torsion spring 32, and the inside cylindrical member 36 are assembled is fitted to an installation hole 2422 of the first hinge piece 24, and is rotatably connected to the inner circumferential surface of the bush 38 as illustrated in FIGS. 2 and 8.

Also, the installation piece 46 that is exposed from the outside cylindrical member 34 is fitted to the first hinge piece 24 by a screw that is not illustrated in the drawings.

Also, the large diameter portion 3404 is inserted into an installation hole 2622 of the second hinge piece 26, and by engaging a protrusion that is not illustrated in the drawings provided on the installation hole 2622 with the mating grooves 3414, the large diameter portion 3404 is fitted to the second hinge piece 26 so that it cannot rotate.

In this way, when the small diameter portion 3402 is rotatably connected to the inner circumferential surface of the bush 38, the installation piece 46 is fitted to the first hinge piece 24 by a screw that is not illustrated in the drawings, and the large diameter portion 3404 is fitted to the second hinge piece 26 so that it cannot rotate, the shaft member 30 is rotated a predetermined number of times with respect to the outside cylindrical member 34, and with the first door panel 16 and the second door panel 18 closing the doorway, the first coil portion 3202 and the second coil portion 3204 are each adjusted in the direction to close the doorway 12 by the elastic force tending to restore the first coil portion 3202 and the second coil portion 3204 in the wind open direction.

Therefore, the upper half of the outside cylindrical member 34 is rotatably supported on the first door panel 16 side via the bush 38, and the lower half is supported so that it cannot rotate on the second door panel 18 side, so in the embodiment, the outside cylindrical member 34 is configured as a support shaft that foldably connects the first door panel 16 and the second door panel 18.

Also, the torsion spring 32 is disposed coaxially with the support shaft via the shaft member 30 inside the outside cylindrical member 34.

When disposed in this state, the first door panel 16 and the second door panel 18 are impelled in the direction to close the doorway 12 by the elastic force tending to wind open the first coil portion 3202 and the second coil portion 3204.

The door opening/closing device 22 that connects the convex portion 2402 at the bottom end of the first hinge piece 24 and the bottom portion of the convex portion 2602 of the second hinge piece 26 is configured in the same way but just the vertical orientation is reversed from the embodiment as described above.

In the embodiment, the shaft member 30 is installed on the first door panel 16 side so that it cannot rotate, and the end portions at both ends of the torsion spring 32 are latched to the second door panel 18 side via the torsion spring latching walls 3408, 3604 respectively, and the center portion of the torsion spring 32 is latched to the first door panel 16 side via the latched member 3206, the latching portion 4808, and the shaft member 30. In other words, both ends of the torsion spring 32 are latched to the second door panel 18 side, and the center portion of the torsion spring 32 is latched to the first door panel 16 side.

Therefore, when the handle 1610 of the first door panel 16 is pulled from the state in which the doorway 12 is closed, and the first door panel 16 and the second door panel 18 are opened against the resistance of the elastic force of the torsion spring 32, the first door panel 16 and the second door panel 18 fold about the outside cylindrical member 34 as center, the outside cylindrical member 34 rotates relative to the shaft member 30, the first coil portion 3202 and the second coil portion 3204 deformed elastically in the direction that they are each wound tighter, and the first door panel 16 and the second door panel 18 are opened and the doorway 12 is opened.

Also, when the hand releases the handle 1610, the first door panel 16 and the second door panel 18 move in the direction to close the doorway 12 as a result of the elastic force tending to restore the first coil portion 3202 and the second coil portion 3204 in the direction that they are each wound open, so the doorway 12 is closed by the first door panel 16 and the second door panel 18. Also, this closed state is maintained by the elastic force that tends to restore the first coil portion 3202 and the second coil portion 3204 to the wound open direction.

According to the embodiment, when the first door panel 16 and the second door panel 18 are opened, in other words, when a load is applied, the first coil portion 3202 and the second coil portion 3204 deform in the wound closed direction, and this is preferable in terms of durability of the torsion spring 32, and therefore the durability of the torsion spring 32 is increased which has the advantage that the durability of the door opening/closing device 22 is increased.

Also, the shaft member 30 is provided that includes the first shaft 40 around which the first coil portion 3202 is wound, the second shaft 42 around which the second coil portion 3204 is wound, and the attaching member 44 to which the latched member 3206 that removably connects these is latched, so fixing the torsion spring 32 to the first door panel 16 and the second door panel 18 is simple, which has the advantage that the assembly work efficiency is increased.

Also, the outside cylindrical member 34 is provided that is configured as a rotational support shaft of the first door panel 16 and the second door panel 18 that covers a portion of the shaft member 30 around which the torsion spring 32 is wound, so this is advantageous in terms of simply and reliably disposing the torsion spring 32 coaxially with the support shaft for rotation of the first and second door panels 16, 18, and, the torsion spring 32 is protected by the outside cylindrical member 34, which is advantageous in terms of further increasing the durability of the torsion spring 32.

The rotational support shaft that rotatably connects the first door panel 16 and the second door panel 18 may be disposed in a different position from the position in which the shaft member 30 and the torsion spring 32 are disposed, but as in the embodiment, when the outside cylindrical member 34 that protects the torsion spring 32 is used as the rotational support shaft, the number of components is reduced which is advantageous in terms of reducing the size of the door opening/closing device 22.

In the embodiment, the application to a double folding door that opens and closes the doorway 12 of the toilet unit 10 of an aircraft was described, but the opening in the present technology is a broad concept that includes not only the doorway 12, but also includes the opening of a closet or storage shelves, and the embodiment can be applied to a wide range of door opening/closing devices that open and close an opening with double folding doors.

The invention claimed is:

1. A door opening/closing device for a double folding door, comprising:

a support shaft that foldably connects a first door panel and a second door panel;

a torsion spring provided between the first door panel and the second door panel coaxially with an axial center of the support shaft, an opening being closed when the first door panel and the second door panel are in the unfolded state, and the opening being open when the door panels are in a folded state, and the torsion spring impelling the first door panel and the second door panel in a direction to close the opening, the torsion spring being made from a single wire member and including a first coil portion and a second coil portion in which the wire member is wound in opposite directions to each other coaxially with a spacing therebetween, and a latched member that connects the first coil portion and the second coil portion, the latched member being latched to a first door panel side, an end portion of the first coil portion on an opposite side to the latched member and an end portion of the second coil portion on the opposite side to the latched member being latched to a second door panel side, and the first door panel and the second door panel being impelled in the direction to close the opening by elastic force that tends to restore the first coil portion and the second coil portion to a wind open direction, wherein a shaft member is provided fitted at a first end in a longitudinal direction to the first door panel so that it cannot rotate and is rotatably supported at a second end in a longitudinal direction by the second door panel, the shaft member includes a first shaft around which the first coil portion is wound, a second shaft around which the second coil portion is wound, and an attaching member that removably connects the first shaft and the second shaft coaxially so that they can rotate integrally, and a latching portion is provided that latches the latched member to the attaching member.

2. The door opening/closing device according to claim 1, wherein the support shaft is configured so that an outside cylindrical member is provided that covers the portion of the shaft member around which the torsion spring is wound, and the outside cylindrical member is configured so that a portion near a first end in the longitudinal direction to the first door panel is rotatably supported by the first door panel, and a portion near a second end in the longitudinal direction to the second door panel is fitted to the second door panel so that it cannot rotate.

3. The door opening/closing device according to claim 2, wherein an inside cylindrical member is connected to the inside of the end of the outside cylindrical member on the side that is fitted to the second door panel so that it cannot rotate, and that rotates integrally with the outside cylindrical member, the latch of the first coil portion to the second door panel at the end portion on the opposite side to the latch portion is formed by latching the opposite side end portion to a latching wall on the inside of the outside cylindrical member, the latch of the second coil portion to the second door panel at the end portion on the opposite side to the latch portion is formed by latching the opposite side end portion to a latching wall on the inside cylindrical member inside the outside cylindrical member, a first end in the longitudinal direction to the first door panel of the shaft member is fitted to the first door panel by fitting to the first door panel an installation piece provided on the end portion of the shaft member projecting from the end portion of the outside cylindrical member on the side rotatably supported by the first door panel, and the support of the shaft member by the second door panel at a second end in the longitudinal direction to the second door panel is by rotatably supporting the end portion of the shaft member, located on the opposite position to that where the installation piece is provided, by the inside cylindrical member.

* * * * *